US006363571B1

(12) United States Patent
Block et al.

(10) Patent No.: US 6,363,571 B1
(45) Date of Patent: Apr. 2, 2002

(54) CONVERTIBLE UPRIGHT VACUUM

(75) Inventors: Thomas S. Block, Muskegon; Jerry D. Schemm, Twin Lake, both of MI (US)

(73) Assignee: Pacific Steamex Cleaning Systems, Inc., Muskegon, MI (US)

( * ) Notice: Subject to any disclaimer, the term of this patent is extended or adjusted under 35 U.S.C. 154(b) by 0 days.

(21) Appl. No.: 09/514,441

(22) Filed: Feb. 24, 2000

Related U.S. Application Data

(60) Provisional application No. 60/121,921, filed on Feb. 26, 1999.

(51) Int. Cl.[7] ..... A47L 5/00
(52) U.S. Cl. ..... 15/335; 15/334
(58) Field of Search ..... 15/331, 332, 334, 15/335, DIG. 10

(56) References Cited

U.S. PATENT DOCUMENTS

| | | | | |
|---|---|---|---|---|
| 2,416,418 | A | * | 2/1947 | Taylor |
| 2,867,833 | A | | 1/1959 | Duff |
| 3,618,158 | A | * | 11/1971 | Worwag |
| 4,171,553 | A | | 10/1979 | Stein |
| 4,376,322 | A | | 3/1983 | Lockhart et al. |
| 4,571,772 | A | * | 2/1986 | Dyson |
| 4,573,236 | A | | 3/1986 | Dyson |
| 4,761,850 | A | | 8/1988 | Romeo et al. |
| 4,955,106 | A | | 9/1990 | Stein et al. |
| 5,358,290 | A | | 10/1994 | Fleet et al. |
| 5,455,984 | A | * | 10/1995 | Blase |
| 5,500,979 | A | * | 3/1996 | Worwag |
| 5,551,120 | A | | 9/1996 | Cipolla et al. |
| 5,586,360 | A | * | 12/1996 | Diedericks et al. |
| 5,617,611 | A | * | 4/1997 | Worwag |
| 6,058,559 | A | * | 5/2000 | Yoshimi et al. |
| 6,079,077 | A | * | 6/2000 | Kajihara et al. |
| 6,209,168 | B1 | * | 4/2001 | Brickner et al. |

* cited by examiner

*Primary Examiner*—Terrence R. Till
(74) *Attorney, Agent, or Firm*—Waters & Morse, PC

(57) ABSTRACT

The invention relates to a vacuum cleaner operable in an on-floor mode and an above-floor mode. The filtration system of the vacuum cleaner is selectively fluidly connected to a brush housing directed toward the floor for the on-floor mode and, in an alternative orientation, selectively fluidly connected to an auxiliary hose for the above-floor mode. The auxiliary hose is stored in its entirety within the hollow tube of an upright handle, the upright handle being pivotally connected to a base of the vacuum cleaner and the hollow tube being removably connected to the pivotal connection for use as a wand in the above-floor mode. The vacuum cleaner includes vacuum and brush motors that are selectively activated in accordance with the position of the upright handle, the vacuum and brush motors being activated the on-floor mode and the vacuum motor alone being activated in the above-floor mode.

33 Claims, 9 Drawing Sheets

CONVERTIBLE UPRIGHT VACUUM

CROSS-REFERENCE TO RELATED APPLICATION

This application claims the benefit of U.S. Provisional Application No. 60/121,921 filed Feb. 26, 1999.

BACKGROUND OF THE INVENTION

1. Field of the Invention

This invention relates to upright vacuum cleaners and, more particularly, to upright vacuum cleaners that are convertible between on-floor and above-floor cleaning modes.

2. Description of Related Art

Upright vacuum cleaners typically include a handle assembly and a base module. Such upright vacuum cleaners that are convertible between above-floor and on-floor cleaning modes include conversion valves for selectively connecting a vacuum source to the suction opening adjacent the floor in the base module for on-floor cleaning or a suction opening on an auxiliary hose for above-floor cleaning. These conversion valves range from rotary valves, handle-operated conversion valves, and removable valve assemblies, and are often complex, resulting in increased manufacturing costs and greater risks of malfunction. Eliminating or reducing the complexity of the conversion valve assembly would reduce overall costs and provide a more reliable vacuum cleaner.

Where such convertible vacuum cleaners include an agitation brush on the base for on-floor cleaning, it is typical to have a height adjustment mechanism for lifting the rotating agitation brush from the surface to be cleaned when the vacuum cleaner is in the above-floor cleaning mode. Often, these convertible vacuum cleaner configurations convert to above-floor operation without disturbing the drive assembly for the rotating agitation brush and at the same time protecting the carpet from damage by the rotating brush. The mechanism for disengaging the agitation brush is sometimes responsive to manipulation of the pivotable handle, wherein a handle-actuated mechanism lifts the agitation brush from the surface to be cleaned when the handle is in the upright or storage position. Other mechanisms are operable by the user, wherein the user can selectively operate a knob or lever on the base module to raise or lower the agitation brush relative the supporting surface. Again, however, these height adjustment mechanisms are typically complex, resulting in higher manufacturing costs and greater risks of malfunction. Reducing the complexity of the mechanical link for disengaging the brush from the supporting surface, or eliminating a mechanical link altogether, would reduce overall costs and provide a more reliable vacuum cleaner.

SUMMARY OF THE INVENTION

The invention relates to an upright vacuum cleaner having a base, an auxiliary hose for above-floor cleaning, and a dirt-collecting filtration assembly having a filter for separating dirt and debris from air and an inlet opening in fluid communication with the filter. The base has wheels for movement along a surface to be cleaned, and a suction nozzle for on-floor cleaning. The inlet opening of the dirt-collecting filtration assembly is adapted to be selectively fluidly connected to the suction nozzle and alternatively selectively fluidly connected to the auxiliary hose. The cleaner includes a suction motor to draw dirty air and debris from the surface to be cleaned through the suction nozzle and into the inlet opening in the dirt-collecting filtration assembly, or alternatively through the auxiliary hose into the inlet opening of the dirt-collecting filtration assembly.

The dirt-collecting filtration assembly is adapted to be selectively positioned in one of two orientations with respect to the suction motor, the suction nozzle and the auxiliary hose. In the first orientation, the inlet opening of the dirt-collecting filtration assembly is fluidly connected to the suction nozzle. In the second orientation, the inlet opening of the dirt-collecting filtration assembly is fluidly connected to the auxiliary hose. The dirt-collecting filtration assembly is mounted in the base and comprises a hopper, and the filter is a filter bag removably mounted in the hopper.

The invention further includes a handle pivotally mounted to the base, with the auxiliary hose is mounted in the handle. The handle comprises a hollow tube that is pivotally mounted to the base, and the hose is mounted and stored within the hollow tube and is collapsible and stored in its entirety with the tube when not in use. The auxiliary hose is mounted at one end in the base and at another end to an upper portion of the hollow tube. The hollow tube is removably mounted to the base and forms a wand for above-floor cleaning, forming at an upper portion a handle grip for manipulating the handle when the hollow tube is pivotally mounted to the base. Above-floor cleaning tools are selectively mountable to the upper portion of the hollow tube for above-floor cleaning.

The invention further includes a first switch for selectively controlling power to the suction motor, and a second switch for selectively controlling power to a drive motor for driving an agitation brush for on-floor cleaning. The first and second switches control power to the suction and drive motors upon rotation of the upright handle from a vertical orientation to an inclined orientation. The first switch also controls power to the suction motor upon removal of the hollow tube from the base.

The invention further relates to an upright vacuum cleaner having a base, an auxiliary hose for above-floor cleaning, and a dirt-collecting filtration assembly having a filter for separating dirt and debris from air and an inlet opening in fluid communication with the filter. The base has wheels for movement along a surface to be cleaned, and a suction nozzle for on-floor cleaning. The inlet opening of the dirt-collecting filtration assembly is adapted to be selectively fluidly connected to the suction nozzle and alternatively selectively fluidly connected to the auxiliary hose. The cleaner includes a suction motor to draw dirty air and debris from the surface to be cleaned through the suction nozzle and into the inlet opening in the dirt-collecting filtration assembly, or alternatively through the auxiliary hose into the inlet opening of the dirt-collecting filtration assembly. The cleaner further has a handle including a hollow tube that is pivotally mounted to the base. The auxiliary hose is mounted at one end in the base and at another end to an upper portion of the hollow tube, and is collapsible and stored in its entirety within the hollow tube when not in use.

The hollow tube is removably mounted to the base and forms a wand for above-floor cleaning, and forms at an upper portion a handle grip for manipulating the handle when the hollow tube is pivotally mounted to the base. Above-floor cleaning tools are selectively mountable to the upper portion of the hollow tube for above-floor cleaning.

The cleaner further includes a first switch for selectively controlling power to the suction motor, an agitation brush for on-floor cleaning and a drive motor for driving the agitation brush, and a second switch for selectively controlling power to the drive motor for on-floor cleaning. The first and second switches control power to the suction and drive motors upon rotation of the upright handle from a vertical orientation to an inclined orientation, and the first switch also controls power to the suction motor upon removal of the hollow tube from the base.

The invention further relates to an upright vacuum cleaner having a base, an auxiliary hose for above-floor cleaning, and a dirt-collecting filtration assembly having a filter for separating dirt and debris from air and an inlet opening in fluid communication with the filter. The base has wheels for movement along a surface to be cleaned, and a suction nozzle for on-floor cleaning. The inlet opening of the dirt-collecting filtration assembly is adapted to be selectively fluidly connected to the suction nozzle and alternatively selectively fluidly connected to the auxiliary hose. The cleaner includes a suction motor to draw dirty air and debris from the surface to be cleaned through the suction nozzle and into the inlet opening in the dirt-collecting filtration assembly, or alternatively through the auxiliary hose into the inlet opening of the dirt-collecting filtration assembly. The cleaner further includes a first switch for selectively controlling power to the suction motor, an agitation brush for on-floor cleaning and a drive motor for driving the agitation brush, and a second switch for selectively controlling power to the drive motor for on-floor cleaning. The first and second switches control power to the suction and drive motors upon rotation of the upright handle from a vertical orientation to an inclined orientation, and the first switch also controls power to the suction motor upon removal of the hollow tube from the base.

BRIEF DESCRIPTION OF THE DRAWINGS

The invention will now be described with reference to the accompanying drawings in which.

DETAILED DESCRIPTION OF THE PREFERRED EMBODIMENT

Figure 1:
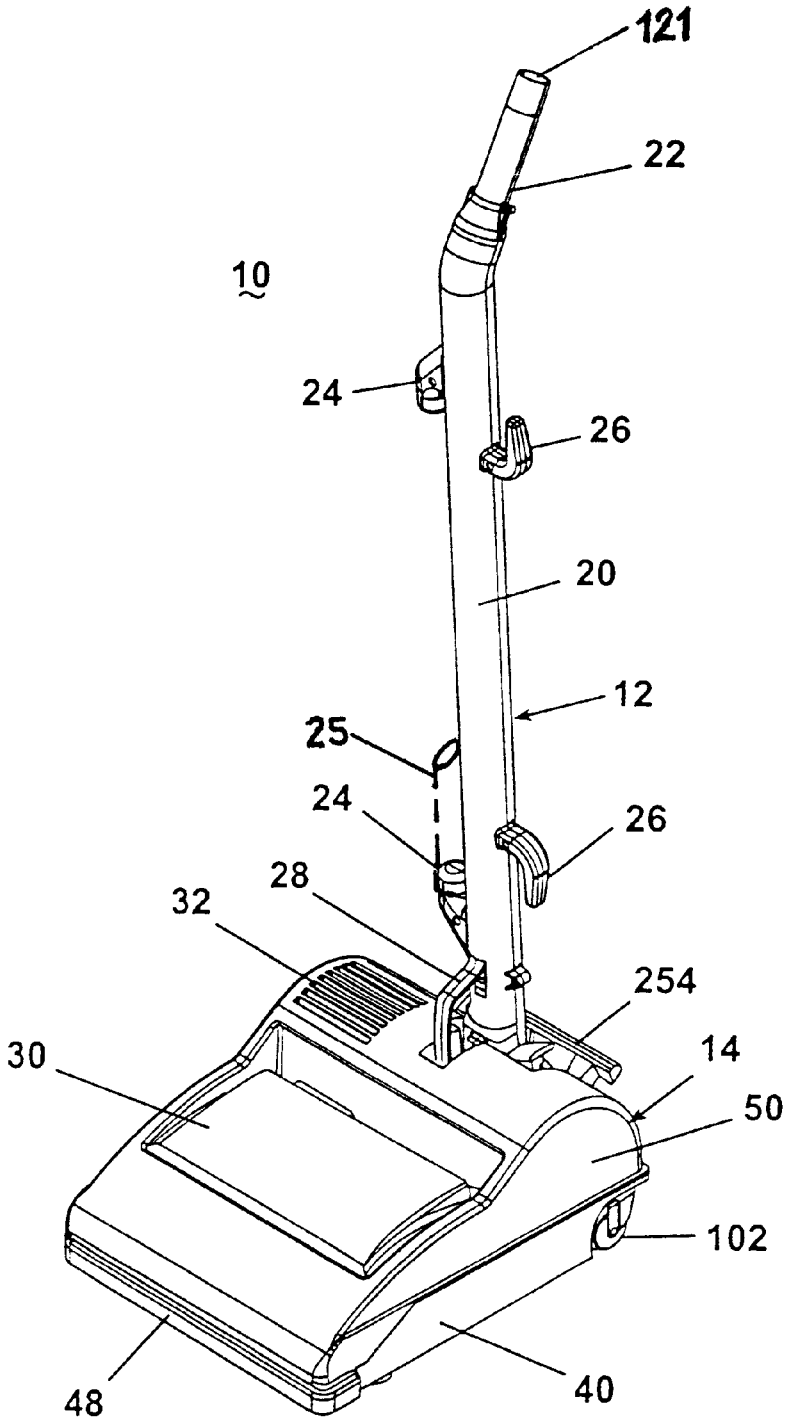
FIG. 1 is a perspective view of an upright convertible vacuum cleaner according to the invention.

Referring now to the drawings and to FIG. 1 in particular, an upright convertible vacuum cleaner 10 according to the invention includes a handle assembly 12 pivotably mounted to a base module 14. The handle assembly 12 includes a tubular portion 20 having at its upper end a first handgrip 22, and at its lower end a second handgrip 28. The tubular portion 20 includes tool clips 24 and cord wrap hooks 26 mounted thereon. The base module 14 includes a filtration hopper 30 removably mounted thereon, and a chassis 40 covered by a hood 50, the chassis 40 including a bumper strip 48, preferably made of a rubber or other resilient material, for protecting furniture and walls from damage due to incidental contact with the vacuum cleaner 10. A rearmost portion of the chassis 40 receives wheels 102 for mobilizing the chassis 40, and a foot pedal 254 for releasing the handle assembly from the vertical position. The hood 50 includes an exhaust vent opening 32.

Figure 2:
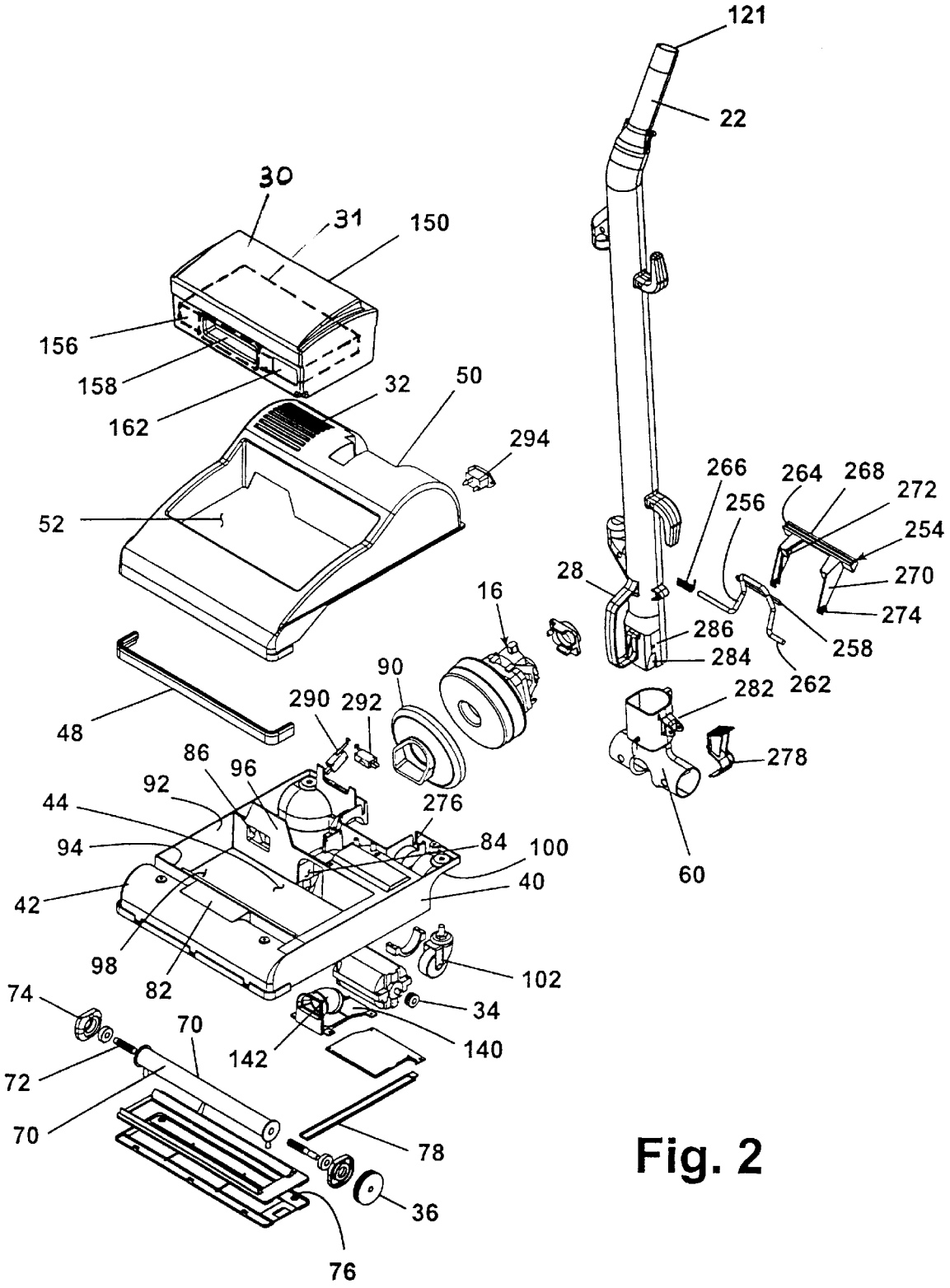
FIG. 2 is an exploded perspective view of the upright vacuum cleaner of FIG. 1 with a filtration hopper in an on-floor cleaning position in the assembly.

With reference to FIG. 2, the chassis 40 includes an arcuate brush housing 42 at a front end for mounting an agitation brush 70 therein. The chassis 40 further includes an intermediately disposed well 44 for seating the filtration hopper 30. The hood 50 has a centrally disposed opening 52 aligned with the well 44. The well 44 is defined by sidewalls 92, a front wall 94, a rear wall 96, and a bottom wall 98. A vacuum motor/impeller assembly 16 is rearwardly disposed in the chassis 40 of the base module 14. The exhaust vent opening 32 in the hood 50 is arranged over the portion of the chassis 40 housing the vacuum motor/impeller assembly 16. The wheels 102 are mounted to the chassis 40 within wells 100.

Figure 7:
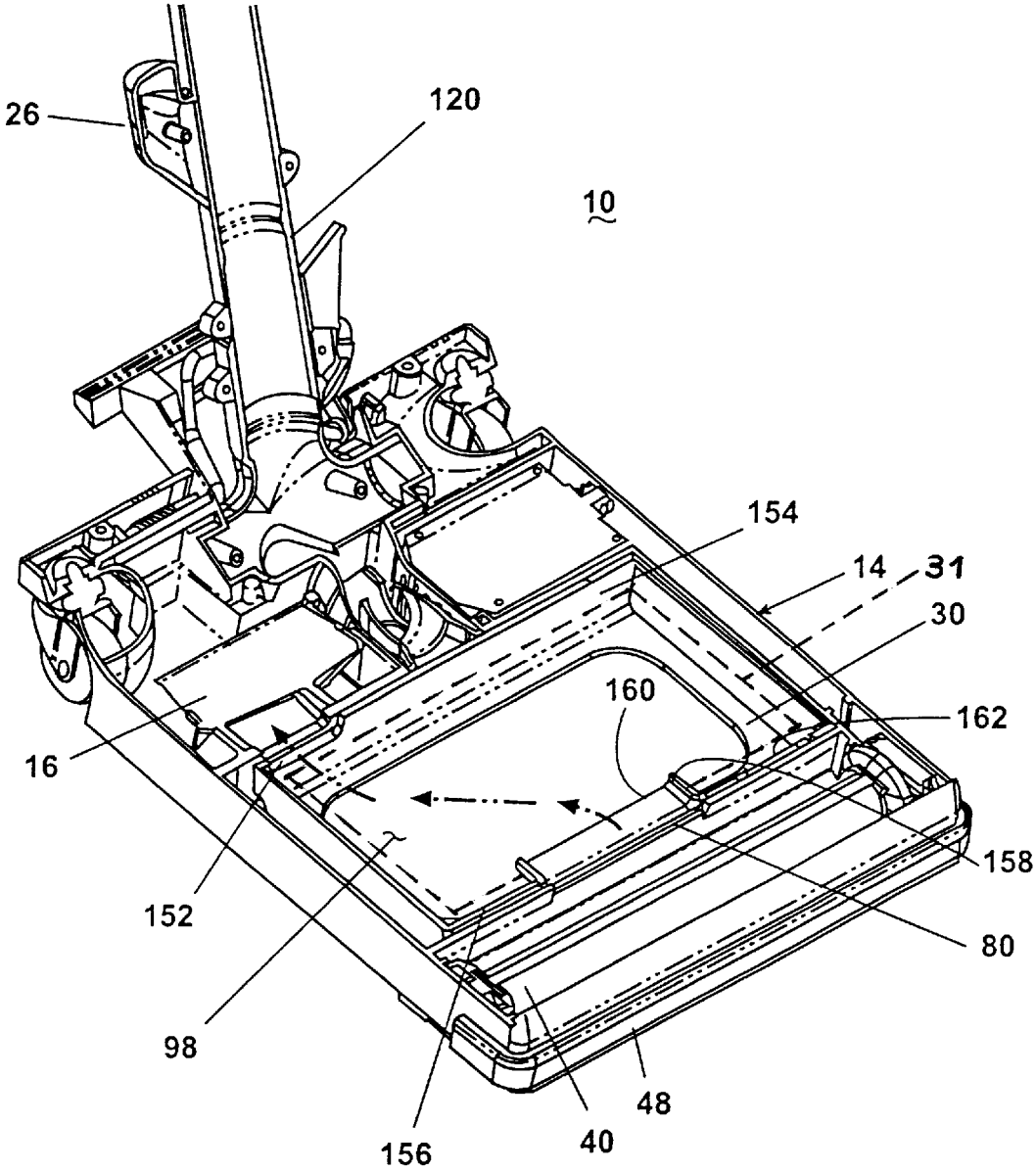
FIG. 7 is an enlarged partial perspective view of the upright vacuum cleaner of FIGS. 1–5 with the hood removed and in on-floor mode, illustrating the air flow path.

The well 44 includes three fluid flow openings: two inlet openings 80, 84, and one exit opening 86. First, the inlet opening 80 (as shown in FIG. 7) is formed in the front wall 94, and fluidly connects the space within the brush housing 42 to the well 44. The inlet opening 80 is connected to the brush housing 42 by an air passageway partially defined by an angled housing portion 82, which is disposed between the brush housing 42 and the front wall 94 of the well 44. The second inlet opening 84 is formed in rear wall 96, positioned opposite the first inlet opening 80, and fluidly connects the well 44 to an auxiliary hose 120 stored within the tubular portion 20 of the handle assembly 12, as will be described farther below. Offset laterally adjacent the second inlet opening 84 is an exit opening 86 also formed in the rear wall 96. The exit opening 86 fluidly connects the well 44 to a vacuum chamber 88 disposed rearwardly adjacent the exit opening 86, on the opposite side of the wall 96 from the well 44. The vacuum chamber 88, a source of low pressure creating working air for removing dirt and debris from surfaces being cleaned, includes the vacuum motor/impeller assembly 16 fluidly connected to the exit opening 86 by an offset impeller gasket 90.

The vacuum motor/impeller assembly 16 generates a vacuum at the exit opening 86, and drive motor 18 drives drive pulley 34, which through at least one drive belt or loop (not shown) and brush pulley 36 drives the agitation brush 70 in conventional fashion. The brush housing 42 at the forward portion of the chassis 40 mounts the agitation brush 70 through axles 72 secured to opposite side ends of the brush housing 42 by bearing boxes 74. A base plate 76, including a belt guard 78, retains the bearing boxes 74, and thus the agitation brush 70, within the brush housing 42. The drive belt or loop is confined to a drive belt chamber 38 (see FIG. 3) formed in chassis 40 on the drive pulley 34 side of the chassis 40 and extending the length thereof. The belt guard 78 of the base plate 76 selectively closes an open bottom portion of the belt chamber 38. Together, the belt guard 78 and belt chamber 38 protect the belt from damage. The bearing boxes 74 receive axles 72 non-concentrically, so that the height of the centerline of the brush 70 above the floor can be adjusted by rotating the bearing boxes 74, to suit the floor material or to adjust for brush wear.

Figure 3:
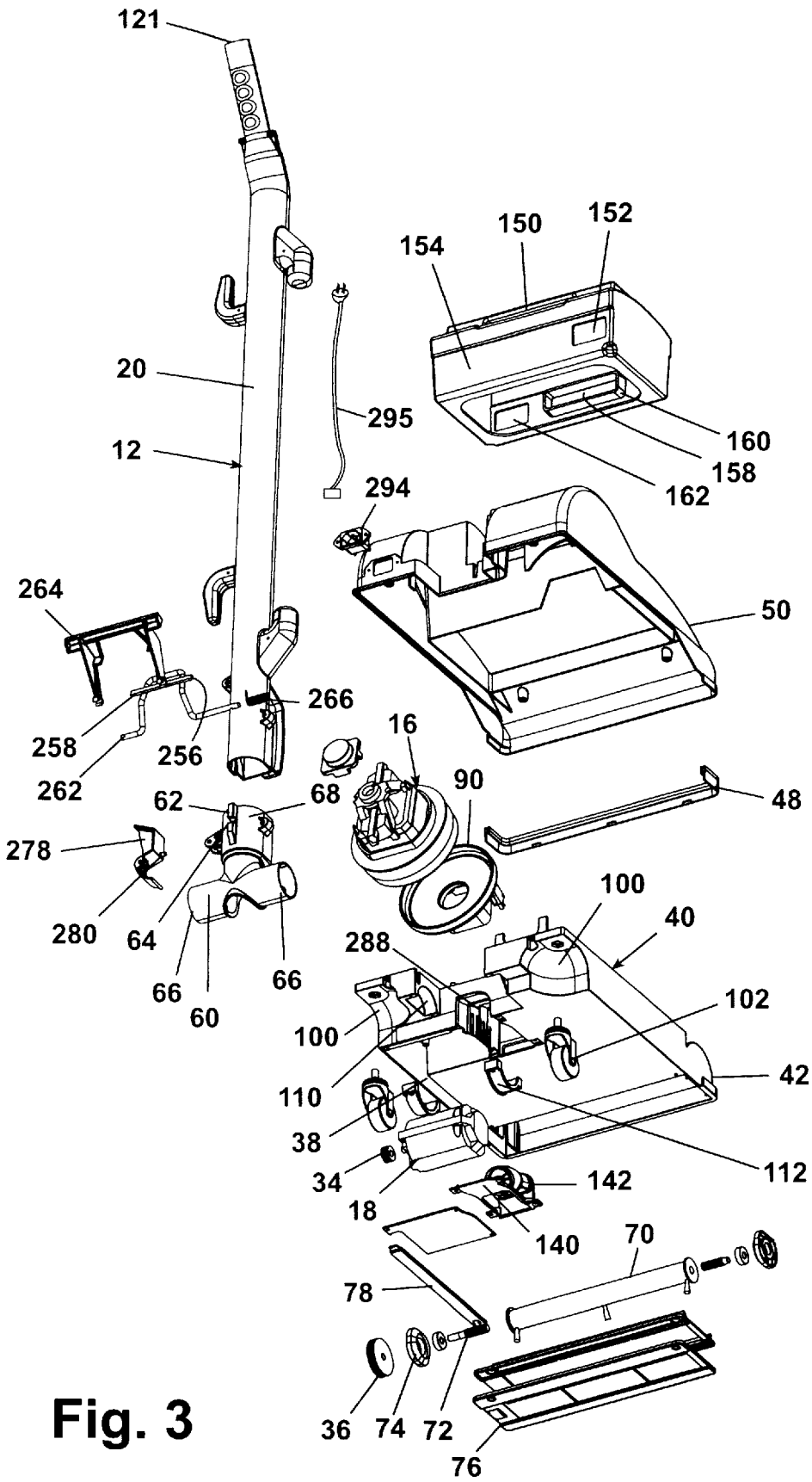
FIG. 3 is an exploded bottom perspective view of the upright vacuum cleaner of FIGS. 1 and 2.
Figure 4:
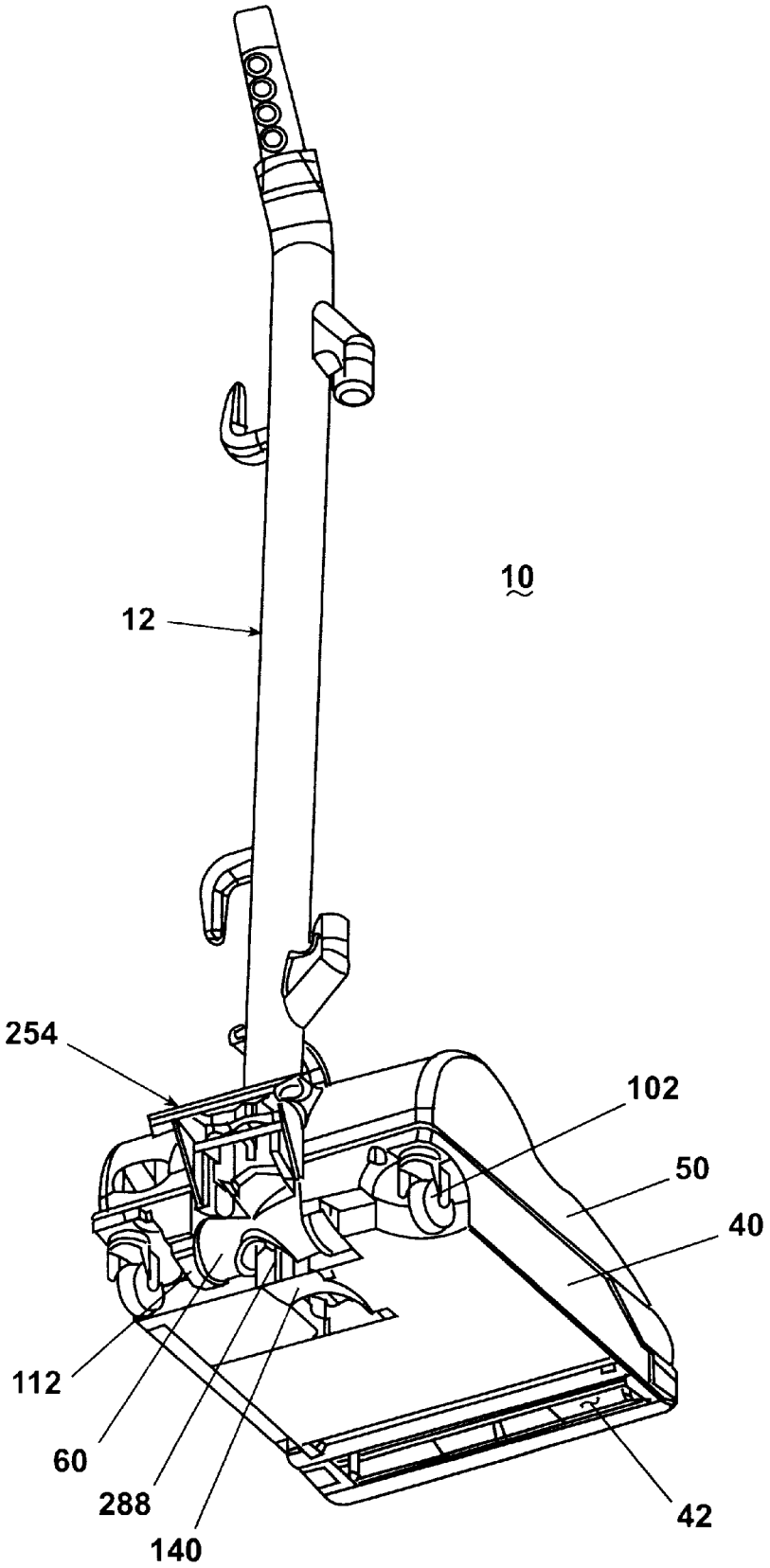
FIG. 4 is a bottom perspective view of the upright vacuum cleaner of FIGS. 1–3.

With reference to FIGS. 2–4, the pivotal connection between the handle assembly 12 and the base module 14 is shown. Specifically, the tubular T-shaped portion 60 at the lower end of tubular portion 20 of the handle assembly 12 is journaled in a bearing socket formed by a concave under portion 110 on the rear most portion of the chassis 40 and U-shaped bearing brackets 112 fastened to the concave under portion 110 to secure the tubular T-shaped portion 60 therein. The T-shaped portion 60 has opposing co-linear pivot arms 66 having a circular cross section for being rotatably received in the bearing socket, and an upstanding hollow body 68 configured to slidably receive the lower end of the handle 12. A resilient lever 278 is rotatably mounted to one side of the body 68, the lever 278 including a pin 280 that is biased through an aperture 282 in the side of the body 68 and into the hollow interior of the body 68. The lower end of the handle 12 has a corresponding ramped portion 284 and recess 286 whereby as the handle 12 is inserted into the hollow body 68, the ramped portion 284 progressively pushes the pin 280 outwardly so the handle 12 can be received in the hollow body 68 until the recess 286 is aligned with and receives the pin 280 to restrict further movement of the handle 12 either into or out of the hollow body 68. For removal of the handle 12 from the T-portion 60, the latch 278 must be depressed to retract pin 280 from recess 286.

The foot pedal 254 comprises three pieces assembled together for engaging the T-portion 60. The foot pedal 254 includes a wireform 256, a pedal portion 264, and a spring 266. The wireform 256 is in the shape of a flat-topped 'A' having a crossbar 258. The base of each leg of the 'A' is bent outwardly to be co-linear with the base of the other leg and form a pivot axle 262. The ends of the crossbar 258 also extend outwardly from the legs of the 'A', parallel to axle 262. The pedal portion 264 has a main body 268 and descending legs 270, each of the legs 270 joining the main body 268 at a shoulder 272 and terminating in an arcuate clip 274. In assembled form, the arcuate clips 274 resiliently snap onto the pivot axle 262 to the outside of each leg of the 'A'. The outer ends of the crossbar 258 are simultaneously captured by the shoulders 272 of the pedal portion 264 so that the wireform 256 and pedal portion 264 form a unit. The spring 266 slips over one of the ends of the axle 262, the pivot axle 262 then being pivotably retained in slots 276 in the rear portion of the chassis 40. The axis of the installed axle 262 is parallel to, but offset above and to the rear of the pivot arms 66 of the installed T-portion 60. Once installed in the housing 40, the foot pedal 254 is biased toward the upright handle 12 by the spring 266. With the upright handle 12 in the vertical position, the pedal 254 is biased against the rear face of T-portion 60, with the upper portion of the 'A' residing in a notch 64 in an abutment 62 on the rear face of T-portion 60. The upright handle 12 is thereby restrained from rotating about the pivot arms 66 by the interaction of the foot pedal 254 and the notch 64. The user who wishes to lower the handle 12 must therefore depress the foot pedal 254 to withdraw the 'A' from the notch 64, thereby releasing the handle 12. The eccentric relative rotations of the foot pedal 254 and the handle 12 are further arranged so that as the handle 12 is rotated rearwardly, the upper portion of the 'A' will again coincide with the notch 64 when the handle 12 is inclined at approximately forty five degrees from vertical. This second detent point provides the user the option and advantage of using the leverage of the upright handle 12 to raise the nose of the chassis 40 for overcoming a raised spot on the floor such as a threshold. The user can continue to depress the foot pedal 254, or can again depress it, to disengage the 'A' from the notch 64 and lower the handle 12 beyond the forty five degree angle of the second detent.

Figure 5:
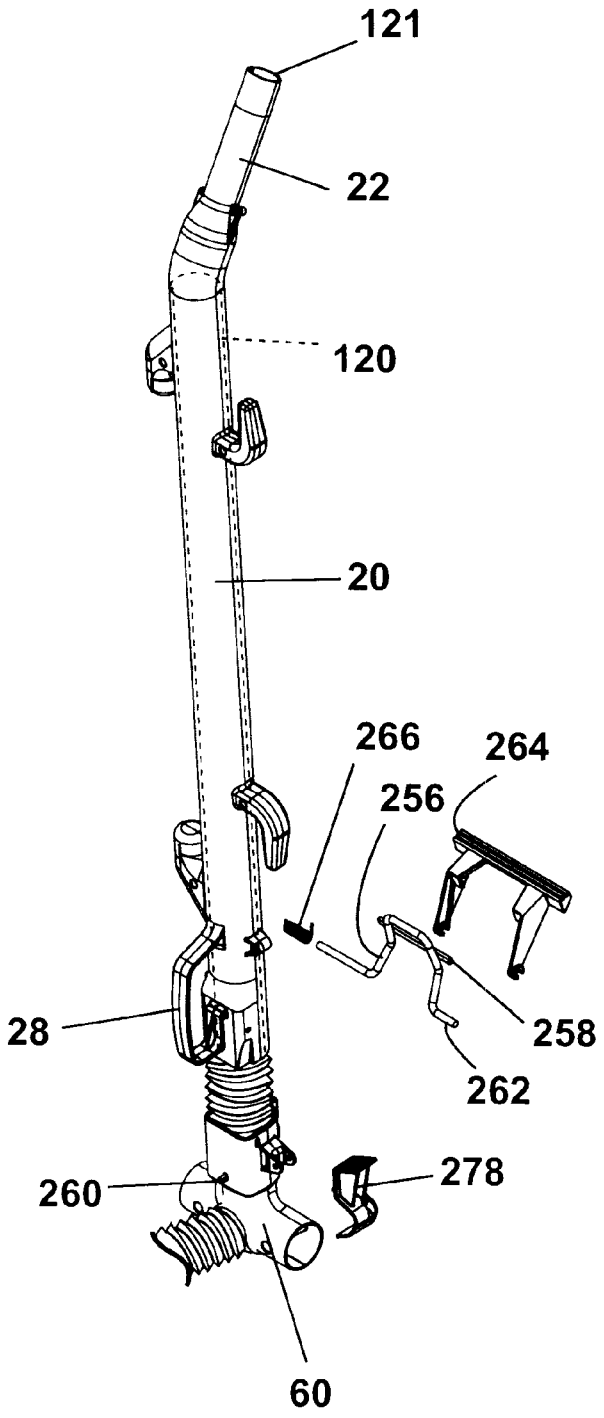
FIG. 5 is a perspective view of the handle assembly of the upright vacuum cleaner of FIGS. 1–4.

Referring to FIG. 5, the auxiliary hose 120 is housed within the tubular portion 20 (hose 120 not shown in FIGS. 2–4 for clarity). Hose 120 fluidly connects the open end 121 of the handgrip 22 to the vacuum chamber 88 via second inlet opening 84, filtration hopper 30, and exit opening 86. Specifically, the flexible hose 120 extends generally coaxially through the tubular portion 20 of the handle 12 from the open end 121 through the hollow body 68. The hose 120 then extends through a channel 288 (see FIGS. 3 and 4) in the underside of chassis 40 to coupling 142 which provides an interface between hose 120 and inlet opening 84 and is unitarily constructed to include a cover 140 to protect and substantially conceal the hose 120. The open end 121 of the handgrip 22 is tapered to receive a conventional cleaning tool 25 such as a crevice tool or brush (shown schematically in FIG. 1).

The filtration hopper 30 is removable from the well 44 of the chassis 40 through the opening 52 of the hood 50 and includes a handle 150 for the user to grasp during removal and replacement. The filtration hopper 30 is preferably a rigid structure for housing a filter bag 31 (shown schematically) for containing the dirt and debris removed from the surface being cleaned. As shown in FIGS. 2 and 3, the generally rectangular filtration hopper 30 includes a first outlet opening 152 formed in a first wall 154 thereof. A second wall 156 on the opposite side of the filtration hopper 30 includes a large central inlet opening 158 defined by a rim 160 and a second outlet opening 162 offset laterally from the inlet opening 158 and in diametric opposition to first outlet opening 152. The aforementioned filter bag would preferably mount over the rim 160.

Figure 6:
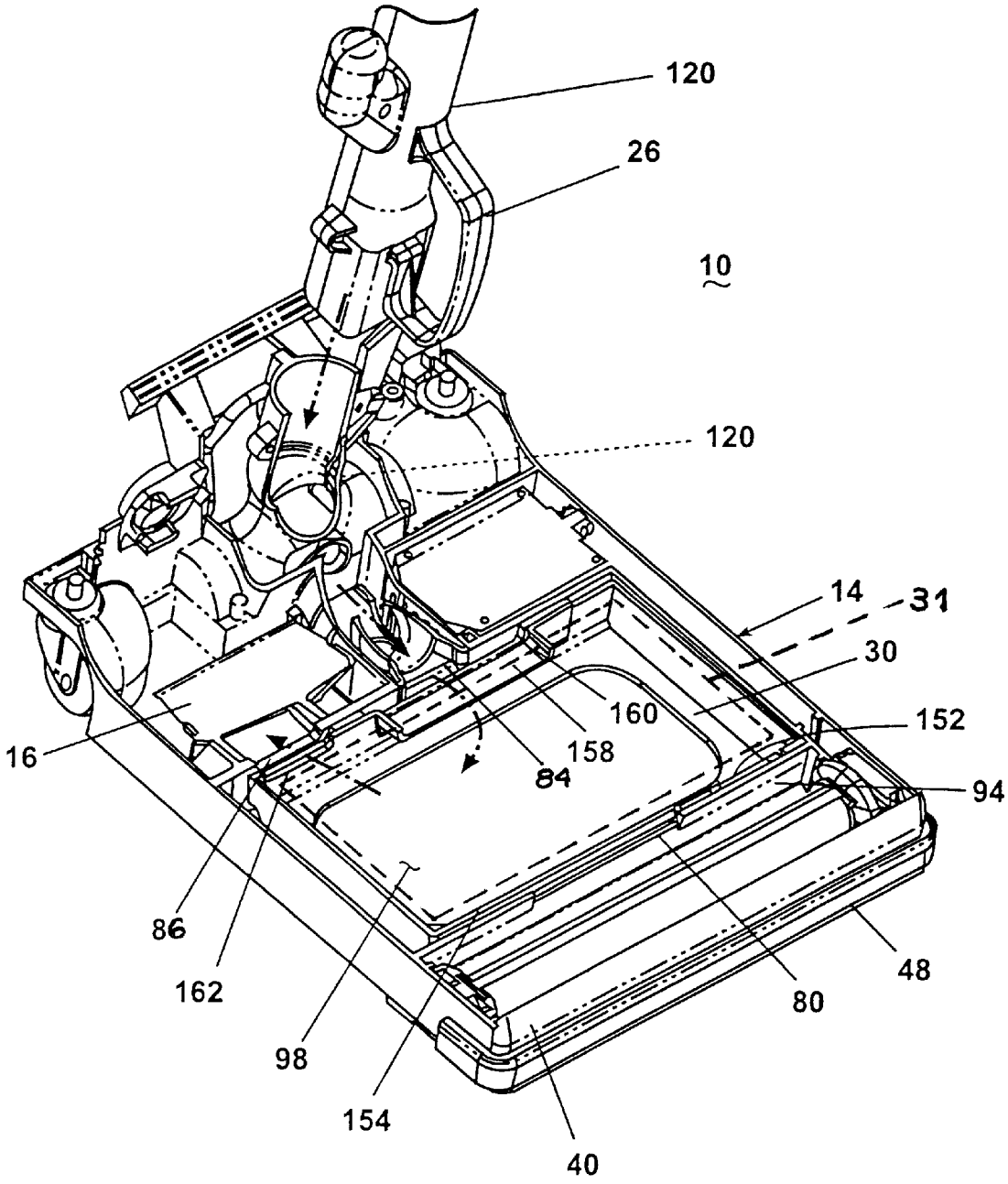
FIG. 6 is an enlarged partial perspective view of the upright vacuum cleaner of FIGS. 1–5 with the hood removed and in above-floor mode, illustrating the air flow path.

The filtration hopper 30 can be reversed in orientation for converting between on-floor and above-floor use. As can be seen in FIGS. 3 and 6–7, outlet openings 152, 162 are opposingly situated on the filtration hopper 30 whereby the outlet openings 152, 162 exchange places within the well 44 upon rotation of the hopper 30. With the filtration hopper 30 in place within the well, one of the outlet openings 152, 162 is always fluidly connected with the vacuum chamber 88 through exit opening 86 while the opposing outlet opening is blocked by the wall 94 of the well 44.

The orientation of the filtration hopper 30 in FIGS. 2, 3 and 7 is oriented for on-floor cleaning, whereby the brush housing 42 at the foremost portion of the base module 14 is placed in fluid communication with the vacuum chamber 88 through the filtration hopper 30. The filtration hopper 30 is oriented so that wall 156 faces forward, and inlet opening 158 is in fluid communication with brush housing 42 through housing portion 82.

When the filtration hopper 30 is reversed in orientation, as illustrated in FIG. 6, the low pressure of the vacuum chamber 88 inlet opening 84 is fluidly connected to the auxiliary hose 120. Thus, in this orientation, the auxiliary hose 120 is in fluid communication with the filtration hopper 30 through inlet opening 158, and thereby is in fluid communication with the vacuum chamber 88 through outlet opening 162. Outlet opening 162, also formed in wall 156 of the hopper 30, is, in this orientation, aligned with and fluidly connected to the vacuum chamber 88. Thus, as illustrated in FIGS. 5 and 6, air is drawn through the upper end 121 of the handgrip 22, through the auxiliary hose 120, and into the filtration hopper 30, where dirt and debris are separated from the air, and then through outlet opening 162 to vacuum chamber 88. FIG. 6 further illustrates that there is no communication between the filtration hopper 30 and the brush housing 42 at the foremost portion of the base module 14. The outlet opening 152 abuts front wall 94 of the well 44 to close off any communication through outlet opening 152. Seals (not shown) are preferably provided around the outlet openings 152, 162 and inlet opening 158 in the filtration hopper 30, and about a bottom surface of the hopper 30 to seal the hopper 30 to the walls of the well 44 and to prevent leakage between the openings in the hopper 30 and the walls of the well 44.

In both configurations, exhaust air is directed through the vacuum motor 16 for cooling thereof, then vented from the vacuum chamber 88 through the exhaust vent opening 32 and, preferably, an associated HEPA filter element (not shown) removably mounted to the hood 50 over the exhaust vent opening 32.

Figure 8:
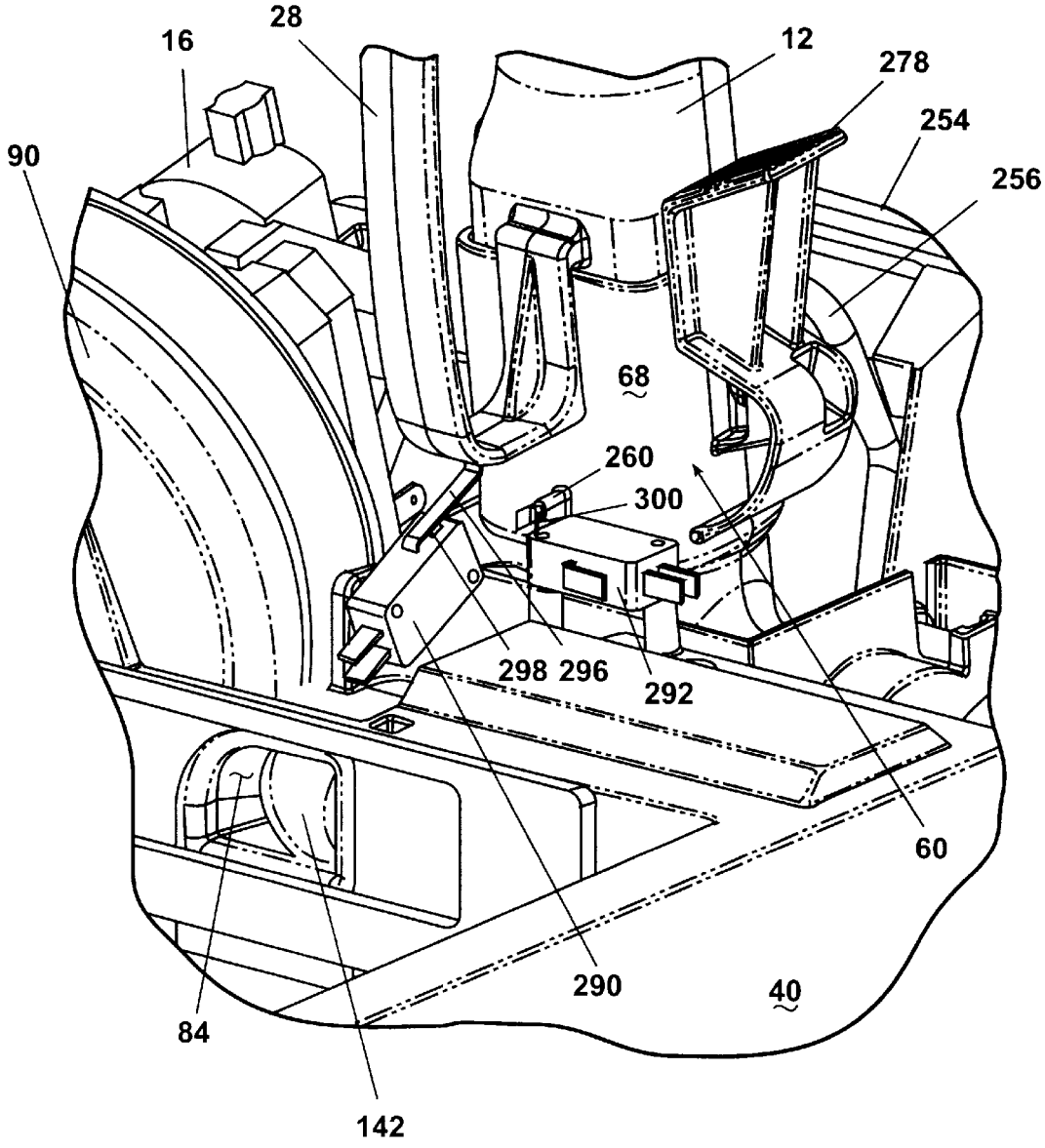
FIG. 8 is an enlarged partial perspective view of the base of the upright handle of the upright vacuum cleaner of FIGS. 1–5, illustrating the interaction of the handle and microswitches with the handle in a vertical orientation.
Figure 9:
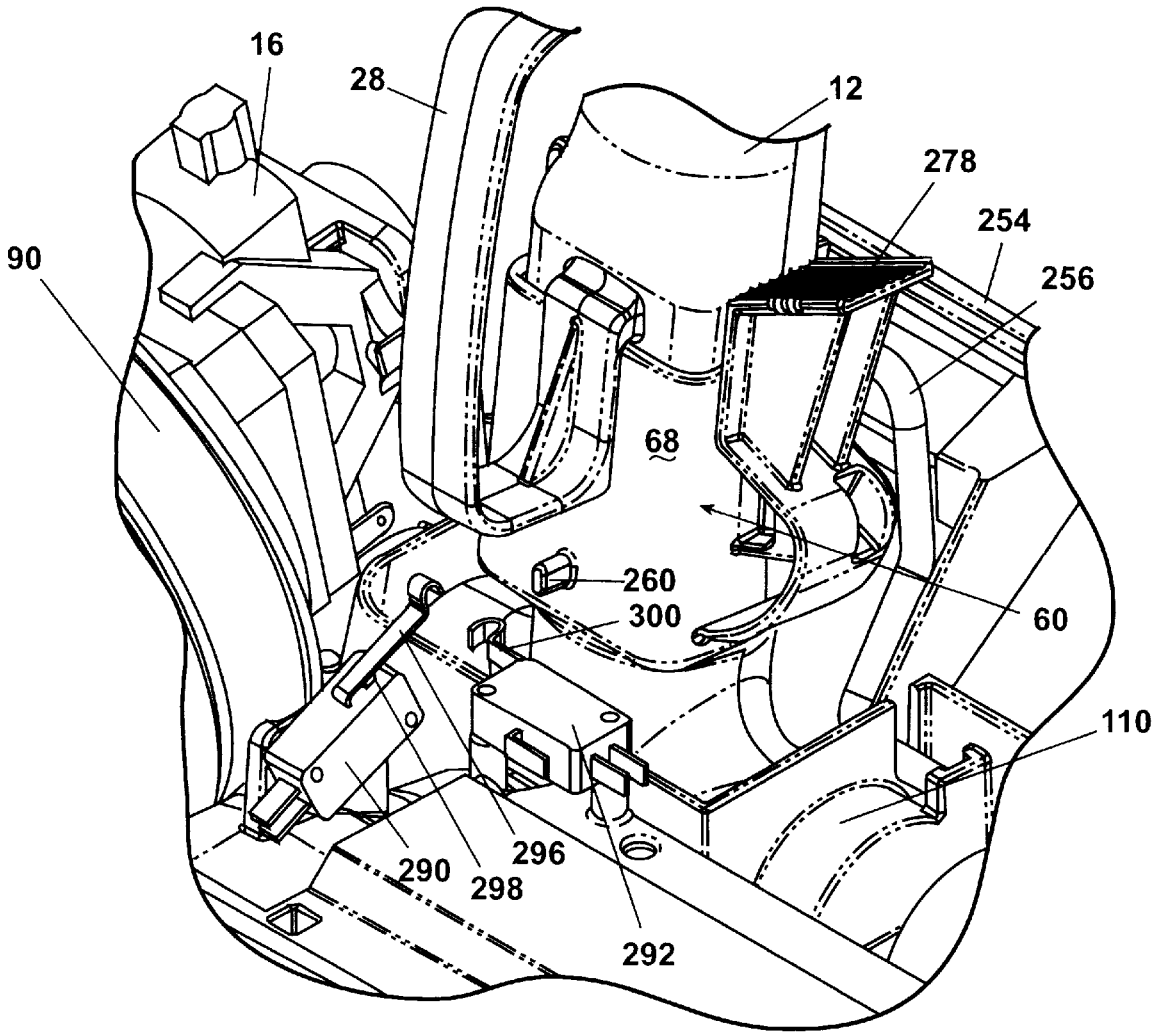
FIG. 9 is an enlarged the partial perspective view, like FIG. 8, showing the upright handle in a tilted orientation.

Referring now to FIGS. 8 and 9, power to the vacuum motor 16 is controlled by a first normally closed microswitch 290 mounted to the chassis 40 adjacent the handle assembly 12. The microswitch 290 is actuated to close when the cleaner 10 is used for on-floor or above-floor cleaning. The microswitch 290 comprises a resilient trigger arm 296 and a spring-biased actuator button 298, the trigger arm 296 overlying the actuator button 298 so that a force applied against the resiliency of the trigger arm 296 and the spring-bias of the actuator button 298 will depress the button 298 and open the electrical circuit in the microswitch 290 and thus interrupt power to the vacuum motor 16. The microswitch 290 is mounted in the chassis 40 adjacent a lower end of the second handgrip 28 so that when the upright handle 12 is in the vertical position and the hollow tube 20 is positioned in the T-portion 60, the lower end of the second handgrip 28 bears against the trigger arm 296 of the first microswitch 290 to depress the actuator button 298 and open the circuit, deactivating the vacuum motor 16. Activation of the cleaner 10 for on-floor cleaning is initiated by depressing the foot pedal 254 and rotating the handle assembly 12 from the vertical orientation to a tilted orientation as illustrated in FIGS. 7 and 9. As the upright handle 12 is rotated away from the first microswitch 290, the trigger arm 296 is released by the second handgrip 28. The removal of this force releases the actuator button 298 and thus closes the electrical circuit in the microswitch 290 so that power is supplied to the vacuum motor 16.

The drive motor 18, which drives the agitation brush 70, is powered when the vacuum cleaner 10 is used in the on-floor mode. Power to the drive motor 18 is controlled by a second microswitch 292 upon rotation of the handle assembly 12 from the vertical. As illustrated in FIGS. 8 and 9, the second microswitch 292 is mounted on the chassis 40 adjacent to the T-portion 60. The second microswitch 292 is normally closed and functions in the same manner as the first microswitch 290 in that the second microswitch 292 comprises a resilient trigger arm 300 and a spring-biased actuator button (not shown), the trigger arm 300 overlying the actuator button so that a force applied against the resiliency of the trigger arm 300 and the spring-bias of the actuator button will depress the button and open the electrical circuit in the microswitch 292. The second microswitch 292 is mounted on the chassis 40 in front of the T-portion 60 so that when the T-portion 60 is in the vertical position, the post 260 bears against the trigger arm 300 to depress the actuator button and open the microswitch 292. In this manner, the electrical circuit to the drive motor 18 is opened. Inclining the handle assembly 12 and therefore the T-portion 60 draws the post 260 away from the trigger arm 300, releasing the actuator button to close the second microswitch 292 and thereby closing the power circuit to drive motor 18.

Upon returning the handle assembly 12 to the upright position, both microswitches 290, 292 are opened as the handgrip 28 and post 260 are brought back to bear on the respective trigger arms 296, 300 and their respective actuator buttons.

For the above-floor mode, it is desirable to activate the vacuum motor 16 while keeping the drive motor 18 deactivated. The first microswitch 290, which controls power to the vacuum motor 16, is operably associated with the second handgrip 28, while the second microswitch 292 is operably associated with the T-portion 60. The cleaner is operated in the above-floor mode by removing the hollow tube 20 from the T-portion 60. The second handgrip 28 thereby serves as the handle for the wand comprising the hollow tube 20. Removing the hollow tube 20 from the T-portion 60 removes the second handgrip 28 from contact with the trigger arm 296 of the first microswitch 290, thereby closing the electrical circuit and providing power to the vacuum motor 16 as described above. As it is not necessary to rotate the T-portion 60 from the vertical position while the cleaner 10 is operated in above-floor mode, the post 260 remains in operative contact with the trigger arm 300 to maintain the second microswitch 292 and the drive motor 18 circuit open. Returning the hollow tube 20 to its engagement within the hollow body 68 of the T-portion 60 again causes the second handgrip 28 to bear against the trigger arm 296, thus deactivating the vacuum motor 16.

Thus the first microswitch 290 is closed when the cleaner 10 is put into operation in either of the on-floor or above-floor modes, thereby generating the suction force required for each mode. The second microswitch 292 is only closed when the cleaner 10 is put into the on-floor mode by moving the T-portion 60 into a reclined orientation.

A further feature of the electrical system of the cleaner 10 is the use of an "IEC" type receptacle 294 (such as is commonly used in computer power supplies) mounted to the hood 50 for removably accepting a mating power cord 295. This connector enables the user to quickly replace a damaged power cord without disassembly of the cleaner 10.

For use in the on-floor mode, the hopper 30 is inserted in well 44 with the inlet opening 158 facing toward the inlet opening 80 and fluidly connected with the brush housing 42. The foot pedal 254 is then depressed and the handle 12 is rotated from the vertical, closing microswitches 290, 292 and activating the vacuum motor 16 and drive motor 18.

For use in the above-floor mode, the hopper 30 is reversed so that the inlet opening 158 is aligned with the inlet opening 84 and fluidly connected with the hose 120. The latch 278 is depressed and the handle 12 is removed from the T-portion 60, closing second microswitch 292 and activating only vacuum motor 16. The hose 120 is collapsible on the order of up to five to one, so that, for instance, a hose 120 fully collapsed into two feet of tubular portion 20 could extend up to ten feet. Second handgrip 28 then serves as a handle for the "wand" that tubular portion 20 has become as the collapsible tube 120 is extended for above-floor cleaning.

While the invention has been described with respect to an upright cleaner having a handle pivotally mounted to a base, the handle can be fixed in an inclined position within a broader scope of the invention. Further, whereas the invention has been described with respect to a dirt-collecting filtration assembly mounted on the base, it is within the scope of the invention also to mount the dirt-collecting filtration assembly on the upright handle. Further, whereas the invention has been disclosed in the context of a clean air vacuum cleaner system wherein dirt and debris are removed from the air stream prior to being drawn through a suction motor, the invention contemplates as well a dirty air system wherein dirt and debris are removed from the air stream after passing through the suction motor.

Reasonable variation and modification are possible within the spirit of the foregoing specification and drawings without departing from the spirit and scope of the invention and the appended claims.

What is claimed is:

1. An upright vacuum cleaner having a base with wheels for movement along a surface to be cleaned and a suction nozzle; an auxiliary hose for above floor cleaning; a dirt-collecting filtration assembly having a filter for separating dirt and debris from air and an inlet opening in fluid communication with the filter; the inlet opening of the dirt-collecting filtration assembly is adapted to be selectively fluidly connected to the suction nozzle and alternatively selectively fluidly connected to the auxiliary hose; and a suction motor to draw dirty air and debris from the surface to be cleaned through the suction nozzle and into the inlet opening in the dirt-collecting filtration assembly, or alternatively through the auxiliary hose into the inlet opening of the dirt-collecting filtration assembly, the improvement which comprises:

the dirt-collecting filtration assembly is adapted to be selectively positioned in one of two orientations with respect to the suction motor, the suction nozzle and the auxiliary hose; in a first orientation, the inlet opening of the dirt-collecting filtration assembly is fluidly connected to to the suction nozzle and, in a second orientation the inlet opening of the dirt-collecting filtration assembly is fluidly connected to the auxiliary hose.

2. The upright vacuum cleaner of claim 1, wherein the dirt-collecting filtration assembly is mounted in the base.

3. The upright vacuum cleaner of claim 2 wherein the dirt-collecting filtration assembly further comprises a hopper and the filter is a filter bag removably mounted in the hopper.

4. The upright vacuum cleaner of claim 3 and further comprising a handle pivotally mounted to the base and wherein the auxiliary hose is mounted in the handle.

5. The upright vacuum cleaner of claim 4, wherein the handle comprises a hollow tube that is pivotally mounted to the base, and the hose is mounted and stored within the hollow tube and is collapsible and stored in its entirety with the tube when not in use.

6. The upright vacuum cleaner of claim 5, wherein the auxiliary hose is mounted at one end in the base and at another end to an upper portion of the hollow tube.

7. The upright vacuum cleaner of claim 6, wherein the hollow tube is removably mounted to the base and forms a wand for above-floor cleaning.

8. The upright vacuum cleaner of claim 7, wherein the hollow tube forms at an upper portion a handle grip for manipulating the handle when the hollow tube is pivotally mounted to the base.

9. The upright vacuum cleaner of claim 8, further comprising above-floor cleaning tools selectively mountable to the upper portion of the hollow tube for above-floor cleaning.

10. The upright vacuum cleaner of claim 7 and further comprising a first switch for selectively controlling power to the suction motor; an agitation brush for on-floor cleaning and a drive motor for driving the agitation brush; and a second switch for selectively controlling power to the drive motor for on-floor cleaning.

11. The upright vacuum cleaner of claim 10, wherein the first and second switches control power to the suction and drive motors upon rotation of the upright handle from a vertical orientation to an inclined orientation.

12. The upright vacuum cleaner of claim 11, wherein the first switch controls power to the suction motor upon removal of the hollow tube from the base.

13. The upright vacuum cleaner of claim 1 and further comprising a handle pivotally mounted to the base and wherein the auxiliary hose is mounted in the handle.

14. The upright vacuum cleaner of claim 13, wherein the handle comprises a hollow tube that is pivotally mounted to the base, and the hose is mounted and stored within the hollow tube and is collapsible and stored in its entirety with the tube when not in use.

15. The upright vacuum cleaner of claim 14, wherein the auxiliary hose is mounted at one end in the base and at another end to an upper portion of the hollow tube.

16. The upright vacuum cleaner of claim 15, wherein the hollow tube is removably mounted to the base and forms a wand for above-floor cleaning.

17. The upright vacuum cleaner of claim 16, wherein the hollow tube forms at an upper portion a handle grip for manipulating the handle when the hollow tube is pivotally mounted to the base.

18. The upright vacuum cleaner of claim 17 and further comprising above-floor cleaning tools selectively mountable to the upper portion of the hollow tube for above-floor cleaning.

19. The upright vacuum cleaner of claim 13 and further comprising a first switch for selectively controlling power to the suction motor; an agitation brush for on-floor cleaning and a drive motor for driving the agitation brush; and a second switch for selectively controlling power to the drive motor for on-floor cleaning.

20. The upright vacuum cleaner of claim 19, wherein the first and second switches control power to the suction and drive motors upon rotation of the upright handle from a vertical orientation to an inclined orientation.

21. The upright vacuum cleaner of claim 20, wherein the first switch controls power to the suction motor upon removal of the hollow tube from the base.

22. The upright vacuum cleaner of claim 1 and further comprising a handle pivotally mounted to the base.

23. The upright vacuum cleaner of claim 1 wherein the dirt-collecting filtration assembly further comprises a hopper and the filter is a filter bag removably mounted in the hopper.

24. An upright vacuum cleaner having a base with wheels for movement along a surface to be cleaned and a suction nozzle; an auxiliary hose for above floor cleaning; a dirt-collecting filtration assembly having a filter for separating dirt and debris from air and an inlet opening in fluid communication with the filter; the inlet opening of the dirt-collecting filtration assembly is adapted to be selectively fluidly connected to the suction nozzle and alternatively selectively fluidly connected to the auxiliary hose; and a suction motor to draw dirty air and debris from the surface to be cleaned through the suction nozzle and into the inlet opening in the dirt-collecting filtration assembly, or alternatively through the auxiliary hose into the inlet opening of the dirt-collecting filtration assembly, the improvement which comprises:

a handle including a hollow tube that is pivotally mounted to the base;

the auxiliary hose is mounted and stored within the hollow tube and is collapsible and stored in its entirety within the tube when not in use; and the auxiliary hose is mounted at one end in the base and at another end to an upper portion of the hollow tube.

25. The upright vacuum cleaner of claim 24, wherein the hollow tube is removably mounted to the base and forms a wand for above-floor cleaning.

26. The upright vacuum cleaner of claim 25, wherein the hollow tube forms at an upper portion a handle grip for manipulating the handle when the hollow tube is pivotally mounted to the base.

27. The upright vacuum cleaner of claim 26, and further comprising above-floor cleaning tools selectively mountable to the upper portion of the hollow tube for above-floor cleaning.

28. The upright vacuum cleaner of claim 24 and further comprising a first switch for selectively controlling power to the suction motor; an agitation brush for on-floor cleaning and a drive motor for driving the agitation brush; and a second switch for selectively controlling power to the drive motor for on-floor cleaning.

29. The upright vacuum cleaner of claim 28, wherein the first and second switches control power to the suction and drive motors upon rotation of the upright handle from a vertical orientation to an inclined orientation.

30. The upright vacuum cleaner of claim 29, wherein the first switch controls power to the suction motor upon removal of the hollow tube from the base.

31. An upright vacuum cleaner having a base with wheels for movement along a surface to be cleaned and a suction nozzle; an auxiliary hose for above floor cleaning; a dirt-collecting filtration assembly having a filter for separating dirt and debris from air and an inlet opening in fluid communication with the filter; the inlet opening of the dirt-collecting filtration assembly is adapted to be selectively fluidly connected to the suction nozzle and alternatively selectively fluidly connected to the auxiliary hose; and a suction motor to draw dirty air and debris from the surface to be cleaned through the suction nozzle and into the inlet opening in the dirt-collecting filtration assembly, or alternatively through the auxiliary hose into the inlet opening of the dirt-collecting filtration assembly, the improvement which comprises:

a first switch for selectively controlling power to the suction motor; an agitation brush for on-floor cleaning and a drive motor for driving the agitation brush; and a second switch for selectively controlling power to the drive motor for on-floor cleaning.

32. The upright vacuum cleaner of claim 31, wherein the first and second switches control power to the suction and drive motors upon rotation of the upright handle from a vertical orientation to an inclined orientation.

33. The upright vacuum cleaner of claim 32, wherein the first switch controls power to the suction motor upon removal of the hollow tube from the base.

* * * * *